US007225511B2

(12) United States Patent
Benedict

(10) Patent No.: US 7,225,511 B2
(45) Date of Patent: Jun. 5, 2007

(54) NON-INERTIAL RELEASE SAFETY RESTRAINT BELT BUCKLE SYSTEM

(76) Inventor: Charles E. Benedict, 3207 Remington Run, Tallahassee, FL (US) 32312

( * ) Notice: Subject to any disclaimer, the term of this patent is extended or adjusted under 35 U.S.C. 154(b) by 78 days.

(21) Appl. No.: 11/013,395

(22) Filed: Dec. 17, 2004

(65) Prior Publication Data

US 2005/0150089 A1 Jul. 14, 2005

Related U.S. Application Data

(63) Continuation-in-part of application No. 10/462,738, filed on Jun. 17, 2003, now abandoned, and a continuation-in-part of application No. 10/669,381, filed on Sep. 25, 2003, now Pat. No. 7,146,692.

(51) Int. Cl.
*A44B 21/00* (2006.01)
*A44B 11/26* (2006.01)

(52) U.S. Cl. ..... 24/635; 24/639; 24/657

(58) Field of Classification Search ..... 24/635, 24/657, 662, 664

See application file for complete search history.

(56) References Cited

U.S. PATENT DOCUMENTS 2,153,077 A * 4/1939 Clarke ..... 24/645
3,605,210 A 9/1971 Lohr
4,809,409 A * 3/1989 Van Riesen ..... 24/635

* cited by examiner

*Primary Examiner*—Jack W. Lavinder
(74) *Attorney, Agent, or Firm*—Dowell & Dowell, P.C.

(57) ABSTRACT

Body restraint systems for vehicles that include buckles for latching and retaining latch plates associated with safety belts. The buckle of each system includes a pair of oppositely biased latching mechanisms that are operative in such a manner that an inertial force applied to release one latching mechanism from a latch plate inserted within the buckle creates an opposite and equal force against the opposite latching mechanism to thereby positively retain the latch plate within the buckle in a locked position. Release of a latch plate can only occur upon the simultaneous movement of both of the oppositely biased latching mechanisms away from one another by application of manual force on a slide release member.

16 Claims, 4 Drawing Sheets

NON-INERTIAL RELEASE SAFETY RESTRAINT BELT BUCKLE SYSTEM

CROSS REFERENCE TO RELATED APPLICATION

This application is a continuation-in-part application of application Ser. No. 10/462,738 filed Jun. 17, 2003 now abandoned entitled NON-INERTIAL SAFETY RESTRAINT BELT BUCKLE SYSTEMS and application Ser. No. 10/669,381 filed Sep. 25, 2003, now U.S. Pat. No. 7,146,692 entitled NON-INERTIAL RELEASE SAFETY RESTRAINT BELT BUCKLE SYSTEMS, both in the name of the present inventor.

BACKGROUND OF THE INVENTION

1. Field of the Invention

This invention is generally directed to vehicle safety restraint systems including shoulder and lap seat belts and more particularly to such restraint systems that include a buckle that houses oppositely biased locking or latching mechanisms that are operable to resiliently engage a locking tong of a latch plate as the latch plate is inserted within the buckle. The latching mechanisms prevent release of the latch plate due to inertial forces created during a vehicle accident, such as a vehicle roll-over. The latch plate can only be released by manual operating a slide release member which cause the simultaneous movement of the latching mechanisms in opposite directions relative to one another to positions wherein the locking tong of the latch plate is no longer engaged.

2. Description of Related Art

Body restraint systems including seat belts, lap belts, shoulder harnesses and the like have been credited with saving numerous lives which otherwise would have been lost in vehicular accidents. The positive benefits obtained due to body restraints systems has been so recognized that, in the United States, the use of seat belts is mandated in all states.

Since their inception, there have been numerous innovative advances made to improve upon the safety and reliability of vehicle body restraint systems. Improvements have been made to the belt and belt materials, the manner in which the belt restraint systems are mounted within vehicles, the manner in which such restraint systems may be automatically adjusted to provide proper tension to suit not only safety standards but to also provide for a measure of passenger comfort and further to improve upon the security of the locking devices and belt buckles associated with such systems.

Most conventional vehicle body restraint systems incorporate a belt which either crosses in front of the lap or diagonally across the body of the vehicle operator or passenger in such a manner as to not adversely interfere with a region of an individual's neck. Belts are retained by latching assemblies including belt buckles into which latch plates carried by the belts can be inserted so as to automatically become locked to the buckles which are normally anchored relative to vehicle frames.

Conventional systems generally utilize two types of release mechanisms for allowing latch plates to be removed from buckle housings such that drivers and passengers can disembark vehicles. A first or side release system includes an operating release button which is generally resiliently urged outwardly at an angle which is perpendicular to an axis or line of insertion of the latch plate into a buckle housing. A second type of conventional release system is known as an end release system and includes an operating lever or button for releasing the latch plate from the buckle housing and which lever is mounted at an end of the buckle housing.

Currently, virtually all types of latching mechanisms for body restraint systems in automotive vehicles are subject to premature release when subjected to at least one mode of inertial force which can be created under various conditions resulting from collisions, roll-overs and other types of loss of vehicle control. Side release latching assemblies or mechanisms, referred to as Type 1 and Type 6 in the industry, will inertially release when subjected to lateral forces which are applied to a backside of a buckle during a vehicle collision or roll-over. Such latching assemblies will also release by the release buttons being forcibly engaged by an object in a vehicle accidently depressing the buttons during an accident, collision or roll-over, thereby prematurely destroying the effectiveness of the restraint systems which can cause severe or deadly injury to persons using the systems.

By way of example, if a person's hip strikes the backside of a buckle frame during an accident, the interior latch which engages a latch plate of a seat belt can and will release when the striking force level is sufficient to cause the inertia of the latch mass, relative to the acceleration and displacement of the buckle frame, to compress a leaf spring and unlatch the buckle.

End type release latching systems will inertially release due to the mass of the release buttons associated therewith when taken into consideration the mass of movement of the latch plate and the direction of rotational release of the latch plate when subjected to an upward or upward and lateral force opposite the locking direction of a latch dog associated with such a mechanism, especially during vehicle roll-overs. This upward or upward and lateral mode of failure occurs when an occupant is more apt to be ejected from a vehicle and thus can result in severe bodily injury or death.

An example of end release latching system for seat belts is disclosed in U.S. Pat. No. 4,358,879 to Magyar. The system uses a release button which is pushed down to release the latch plate as opposed to being pushed laterally as in the side release systems.

Virtually all end release buckles, generally referred to as Type II buckles, operate using an over-the-center mechanism so the actual latch uses either a fairly weak compression spring or a leaf spring for a latching force. A so called "lock for the latch" is a rod or bar that follows an "L" shaped track where the lock bar moves laterally across the buckle frame in a direction of latch movement and then moves vertically along a leg of the "L" and behind the latch after the latch goes over-the-center to its latched position. This movement supposedly locks the latch from moving laterally from lateral forces acting on the buckle frame that would inertially move the latch laterally relative to the buckle frame.

However, the end release buckles have a release button, release slider, lock bar (pin) latch and two compression springs, all of which have mass. One spring actuates the latch laterally and the other spring acts against the latch plate to keep a locking edge in contact with the latch surface or "dog" and applies an upward force against the release button. This spring also acts to eject the latch plate from the buckle when the latch button is depressed and the latch is disengaged.

When vertical forces, or forces with enough vertical component on a buckle, such as forces created by impacts to a bottom of a vehicle in a roll-over, are sufficiently high enough, the buckle latch will release. The design of these buckles is such that both a vertical (longitudinal) and horizontal (lateral) component of force will cause a premature release. In many cases, a vertically upward forces causes an equally vertical downward inertial force to the release button and related components, which causes them to move in a downward (release) direction due to their mass and acceleration relative to the buckle frame. When the components of the release mechanism approach an elbow of the locking "L" slot, the locking pin or bar follows the path of the slot and releases the latch and the compression spring against which these inertia forces are acting, and ejects the latch plate.

The forces acting on a latch plate/buckle assembly that create inertia forces in a release direction come from various and foreseeable sources and directions and always follow Newton's Law. Some of these are:

a) vertical to horizontal forces acting on a vehicle and thus a buckle assembly from impact to the ground during vehicle roll-overs;
b) vertical to horizontal forces acting on a vehicle and thus on a buckle assembly from impact to the vehicle from another vehicle, fixed object or other movable object within a path of the vehicle;
c) vertical to horizontal forces acting on a buckle assembly by objects within the vehicle, such as occupants or loose objects;
d) vertical to horizontal forces acting on a buckle assembly from it being driven into objects within the vehicle, such as a center console between a driver and a passenger or between vehicle occupants; and
e) vertical to horizontal forces acting on a latch plate and release mechanism mass from impulses resulting from emergency management loop release as well as harness mounted air bags and the like where tension on a harness/lap belt webbing is suddenly tightened or released causing a large, near longitudinal impulse force into the buckle, latch plate and release mechanism mass sufficient to cause an acceleration of the mass of the release mechanism parts to develop an inertia force exceeding a release mechanism spring force acting against a release mechanism mass.

A latch plate weighs anywhere from approximately two (2) to five (5) ounces, depending on whether it is a slip, partial slip or slip lock latch plate. A weight (mass) of the release components of the buckle (button, slider, locking pin, etc.) is a fraction of the latch plate weight.

The dynamic problem with the end release buckles is that when there is an upward force or upward component of force acting on the buckle or a downward impulse from sudden tensile loading/unloading of seat belt webbing through the latch plate, the latch plate mass applies a downward inertia force or impulse that drives an unlatch mechanism downward toward an unlatch position, accelerating the unlatch mechanism masses downward and thus causing the latch to release. Any horizontal or lateral force acting on the buckle frame in an opposite direction to the unlatch direction compounds the unlatching due to acceleration forces acting on the buckle frame.

The above modes of failure are inherent in virtually all conventional side and end release latching mechanisms of conventional vehicle restraint systems. The side release buckle systems are generally simpler and have fewer moving parts and thus are more economical to construct and to install, whereas the end release systems are more complex having multiple moving parts and are thus more expensive to manufacture.

In view of the foregoing, there remains a need to further improve upon the reliability and effectiveness of vehicle body restraint safety belt systems to ensure that the latching mechanisms associated therewith cannot be accidently released during substantially any type of vehicular movement caused during accidents, collisions or resulting from loss of control of a vehicle, such as by operator error or vehicle equipment failure. There is a further need to provide for improvements in vehicle body restraint systems which permit the latching assemblies to be more reliable and more economical to construct.

In applicants application Ser. No. 10/462,738, the contents of which are incorporated herein, in their entirety, by reference, a safety belt restraint system is described which prevents the release of a latching or locking mechanism of a safety belt restraint system by inertial forces which may be directed against the latching assembly during a vehicle accident. In accordance with the invention, each buckle includes a first latch mechanism including a latch dog which is engageable within an opening in a latch plate as the latch plate is inserted within a buckle housing. The latching mechanism is positively retained in engagement with the latch plate by two equally resisted and oppositely oriented push button release mechanisms. The release mechanisms are connected by a resilient element, such as a spring, such that any force tending to push one of the release buttons inwardly of the buckle to effect a release of the latch plate places an equal and opposite force on the opposite release button to sustain it in a locked position thereby preventing release of the latch plate from the buckle. With this structure, equal and opposite forces must be simultaneously applied to each of the release buttons in order to cause a camming of the latch relative to the latching mechanism to thereby permit withdrawal of the latch plate.

In applicant's application Ser. No. 10/669,381, the contents of which are incorporated herein, in their entirety, by reference, an embodiment of the invention is disclosed wherein latching mechanisms are provided in the form of slide blocks which are positively guided between a pair of fixed guide blocks which define channels therebetween in which the latching mechanisms are reciprocally moveable against a spring or other resilient element which extends therebetween so as to apply equal and opposite biasing force against each latching mechanism. Each of the slide blocks of the latching mechanisms also includes a lock dog which is engageable with bifurcated hooked tongs of a latch plate when the latch plate is inserted within the buckle housing to thereby retain the latch plate in a locked position. The slide blocks further include a tapered camming surfaces which extend inwardly toward a central longitudinal axis of the buckle housing from the lock dogs toward the opposite end of each slide block. In the embodiment, a single longitudinally slidable release member is used to create an equal and opposite force to move the latching mechanisms from their first locked position to their second release position. The forward end of the slide member includes two spaced legs which are designed to cooperatively engage the camming surfaces associated with each of the slide blocks. To release the latching mechanisms from engagement with the locking tongs of the latch plate, the release member is manually urged inwardly of the buckle housing wherein the legs will engage the camming surfaces of the slide blocks thereby simultaneously urging them toward one another against the spring or other resilient element extending therebetween, thereby moving the latching mechanisms to their second release positions.

SUMMARY OF THE INVENTION

The present invention is directed to body restraint systems especially adapted for automotive and other vehicles that include buckles for latching and retaining latch plates mounted to seat or lap belts of safety harnesses which operate as a kinematic inversion with respect to the buckles disclosed in application Ser. No. 10/669,381. In the present invention, once a latch plate has been inserted within a buckle, the latch plate is engaged by a pair of oppositely oriented latching mechanisms which are equally positively biased in opposite directions. In this manner, if there is an application of an inertial force to either latching mechanism in a direction to move it from a locked position, engaging the latch plate, to an unlocked position, to release the latch plate, an opposite and equal inertial force will be directed to the opposite latching mechanism to retain the opposite latching mechanism in engagement with the latch plate. The release of the latch plate from the buckle is only possible by the simultaneous movement of the oppositely biased latching mechanisms in a direction away from one another. Thus, both latching mechanisms cannot be simultaneously released by the application of inertial forces which may be applied against the buckle.

The safety belt assembly of the restraint system is provided with a latch plate having a single forwardly extending locking tong which is receivable within a buckle upon insertion of the latch plate. The tong has oppositely oriented hooks which are designed to moveably engage the oppositely biased latching mechanisms during latch plate insertion such that lock dogs associated with each latching mechanism engage the hooked ends of the locking tong to thereby prevent removal of the latch plate.

The pair of latching mechanisms are slidable mounted within the buckle and are biased by separate resilient elements or springs which normally urge the latching mechanisms to their innermost or first locking positions wherein they positively engage and retain the locking tong of the latch plate. Further, the buckle includes a manually operated release mechanism which is effective to simultaneously urge each of the oppositely biased latching mechanisms away from one another to a second release position wherein lock dogs associated therewith are withdrawn from engagement with the locking tong of the latch plate such that the latch plate may be withdrawn from the buckle.

The latching mechanisms are in the form of slide blocks which are positively guided between separate pairs of fixed guide blocks which define a channel therebetween in which the latching mechanisms are reciprocally moveable, each against a spring or other resilient element, which apply equal and opposite biasing force against each latching mechanism urging them toward one another. Each of the slide blocks of the latching mechanisms includes a lock dog which is engageable with the hooked ends of the tong of the latch plate when the latch plate is inserted within the buckle housing to thereby retain the latch plate in a locked position. Each of the slide blocks further includes a tapered camming surface which extends inwardly toward a central longitudinal axis of the buckle from the lock dog toward the opposite end thereof.

A release button is integrally formed with and extends upwardly from a rear portion of a slide release member. The body of the slide member is of a size to be guidingly received within a pair of channels formed by an inner frame of the buckle. The forward end of the slide member includes a single projection which is designed to cooperatively engage between the camming surfaces associated with each of the slide blocks. To release the latching mechanisms from engagement with the locking tong of the latch plate, the slide release member is manually urged inwardly of the buckle wherein the projection will engage the camming surfaces of the slide blocks thereby simultaneously urging them away from one another against the springs or other resilient elements, thereby moving the latching mechanisms to their outer or second release positions.

The invention also includes a lock bar that is resiliently mounted between the fixed guide blocks and the slide release member. The lock bar includes outer blocking flanges which are normally spaced from the latching mechanisms but which are moveable, upon external force being applied axially of the buckle which would tend to drive the slide release mechanism to it's release position, to block the latching mechanisms from being moved to their release positions. In this manner, the latching mechanisms cannot be accidentally moved to release the latch plate.

It is the primary object of the present invention to provide a safety restraint system for use with lap and shoulder belts associated with vehicles a which includes a buckle having latching mechanisms which can not be released by inertial forces applied to the components thereof, such as caused during vehicle accidents, including roll-overs.

It is yet another object of the present invention to provide latching and locking mechanisms for seat belt restraint systems which are operative in accordance with Newtonian Laws of Physics to the effect that for every action, there is an equal and opposite reaction, so that a latch plate of one of the systems can not be released from a buckle unless oppositely directed forces are applied to oppositely biased latching mechanisms associated with each restraint system.

It is another of the present invention to provide non-inertial release restraint buckles for use in seat belt restraining systems of the type used in automotive vehicles and the like wherein latching mechanisms associated with each buckle are structured from a minimal number of moving components to thereby reduce the risk of component failure while decreasing manufacturing costs.

BRIEF DESCRIPTION OF THE DRAWINGS

A better understanding of the invention will be had with respect to the embodiment of the invention shown in the attached drawings wherein.

DESCRIPTION OF THE PREFERRED EMBODIMENT

Figure 1:
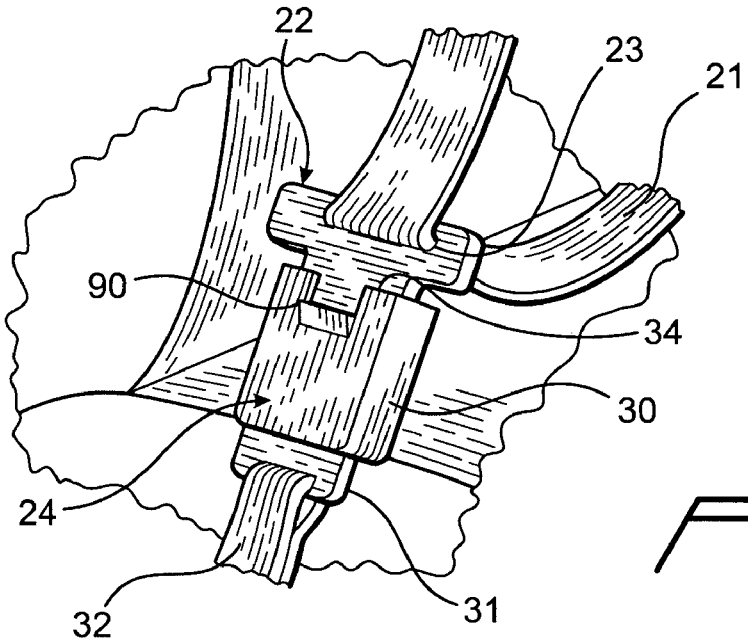
FIG. 1 is a perspective illustrational view of the invention wherein a latch plate connected to a conventional seat belt is secured with a buckle which is anchored relative to a vehicle by conventional anchor belt.

With continued reference to the drawing figures, the non-inertial release restraint buckle assembly 20 of the present invention is shown as used with a seat belt restraint system in an automotive vehicle. The restraint system includes a seat belt 21 in the form of a harness and lap belt that is connected to a latch plate 22 that is specifically designed to be cooperatively used with a buckle 24. The latch plate 22 includes an outer body portion having an open slot 23 therein through which the belt extends and also includes an inner body portion which is guidingly receivable within the buckle and from which extends an inner locking tong 25. The locking tong includes oppositely oriented outwardly directed hooked end portions 27 and 28 for purposes of cooperating with latching mechanisms mounted within the buckle 24. As shown, the ends are tapered for purposes which will be described in greater detail hereinafter.

With buckle 24 includes an outer housing 30 which substantially covers and is secured to a metallic frame 31, one end of which is connected to the vehicle by way of an anchoring belt 32. The buckle includes an opening 34 at it's opposite or front end for receiving the latch plate 22.

With reference to drawing FIGS. 3–12, the interior of the buckle and latch plate are generally shown with housing 30 of the buckle being removed for purposes of clarity. With specific references to FIGS. 3–8, the buckle frame 31 includes a pair of general u-shaped side wall portions 36 and 37 which define channels 38 for guiding and receiving the latch plate 22 as it is inserted within the opening 34 in the front of the buckle.

The buckle assembly of the present invention is specifically designed to incorporate latching mechanisms which prevent release of the latch plate which could be brought about by inertial forces being directed against the buckle, such as would occur in a vehicle roll-over or other vehicle accidents when no intent is made on the part of the passenger to release the latch plate from the buckle. Such forces could be applied by objects accidently engaging a release button associated with the invention or by directing forces against the buckle housing which would tend to move the latch assemblies from their locked positions. In this respect, the restraint system of the present invention specifically provides for oppositely biased latching mechanisms so that equal and opposite forces must be applied simultaneously to the pair of latching mechanisms to move them to release positions so that the latch plate can be removed from the buckle 24.

As shown in FIGS. 3, 4, 9, 11 and 12, the latching mechanisms 40 and 41 are in the form of slide blocks which are mounted within a guide channel 42 defined between two pair of fixed guide blocks 43, 44 and 45, 46. The guide blocks are fixedly secured to the buckle frame 31 by rivets or other suitable fasteners (not shown) extending through a bottom wall 47 of the buckle frame 31.

Figure 12:
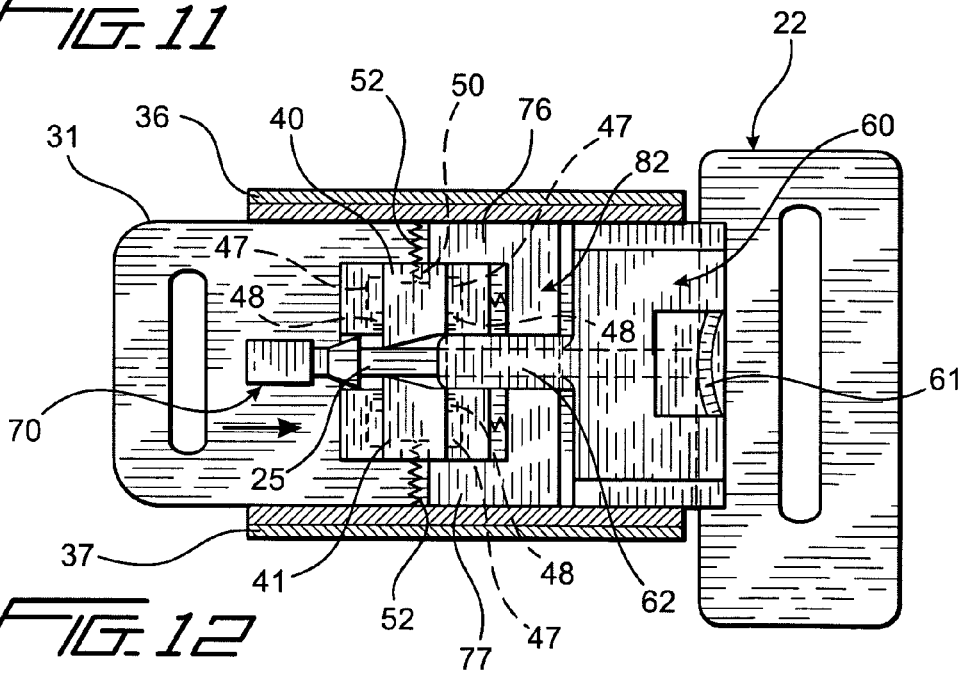
FIG. 12 is a view similar to FIG. 11 except showing the slide release member in position over the u-shaped lock for the latch mechanism and illustrating how the slide release member may not be moved by force applied axially along the axis A—A to move the to the second outer release position as the u-shaped lock prevents outer movement of the latch mechanisms.

As shown in dotted line in FIG. 12, each of the inner faces of the guide blocks 43, 44, 45 and 46 includes a slot 47 in which is received a guide member or tab 48 extending from each side of the latching mechanisms 40 and 41. The slots and the guide tabs associated with each of the latching mechanisms prevent the displacement of the latching mechanisms relative to the guide channel 42 define between the two sets of opposing guide blocks and also limit the inner and outer movement of the latching mechanisms relative to one another.

Figure 3:
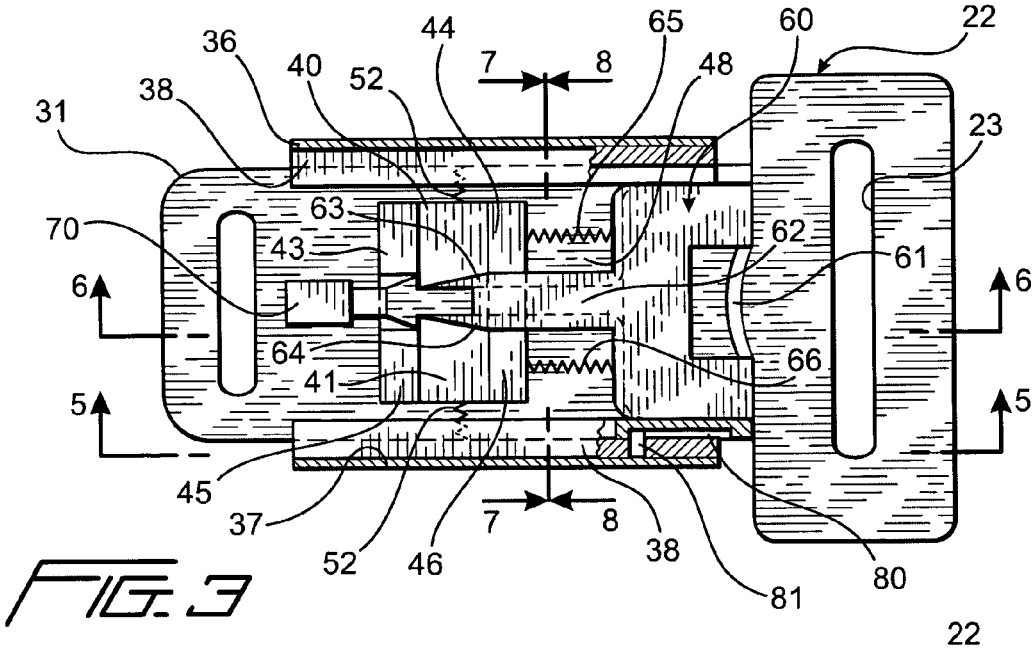
FIG. 3 is a top plan view of the buckle assembly of FIGS. 1 and 2 with the outer housing of the buckle removed to show the operative components associated with the latching assembly and the slide release member.

With continued reference to FIG. 12, each of the latching mechanisms 40 and 41 also includes an opening 50 shown in dotted line for purposes of receiving one end of a resilient member, such as a coil spring 52, associated with each of the latching mechanisms. The opposite end of each spring is securely seated against the inner walls of the buckle frame 31 so that each spring 52 applies a resilient force urging the latching mechanisms 40 and 41 towards one another as shown in FIG. 3. Each spring applies the same amount of force to the adjacent latching mechanism so that the same forces must be applied simultaneously to both latching mechanisms 40 and 41 to urge them to their outer or release position, as shown in FIG. 4.

Figure 4:
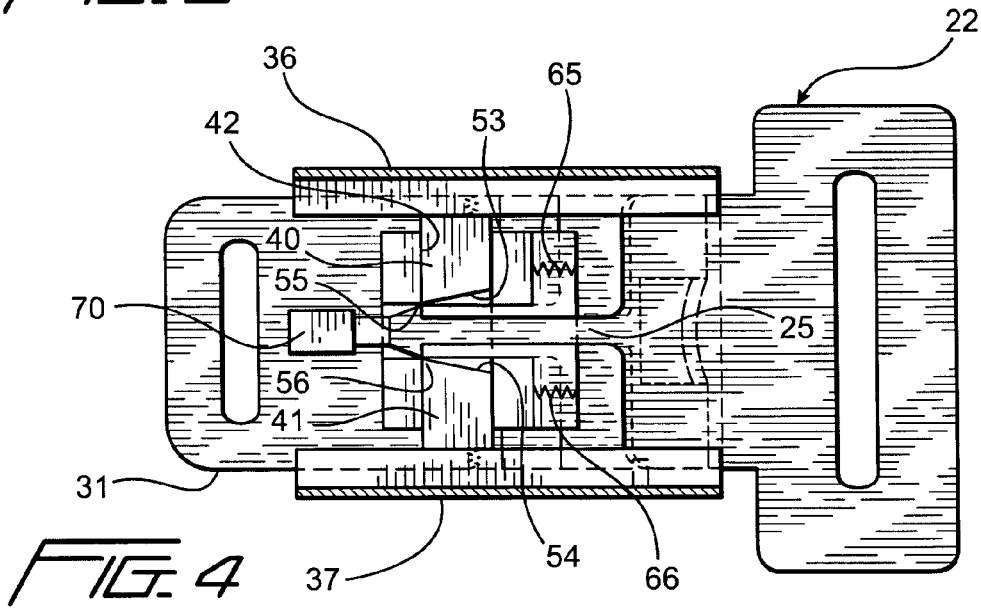
FIG. 4 is a top plan view similar to of FIG. 3 except showing the resiliently biased latching mechanisms moved by the slide release member to a second outer release position to permit withdrawal of the latch plate from the buckle.
Figure 5:
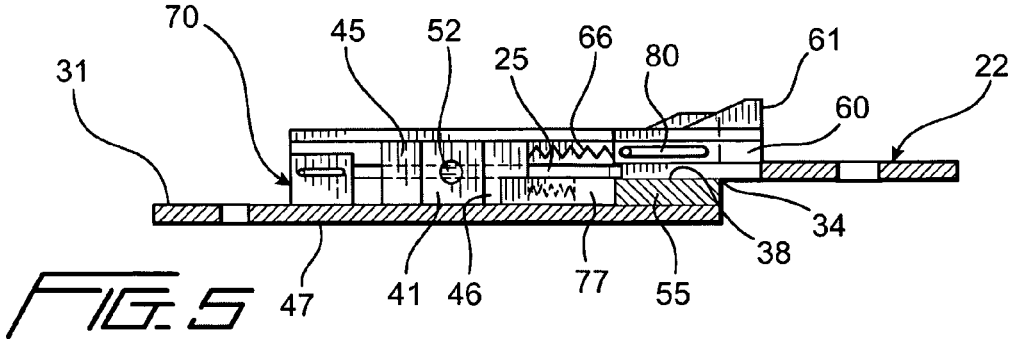
FIG. 5 is a cross-sectional view taken along line 5—5 of FIG. 3.

In FIG. 4, the locking tong 25 of the latch plate 22 is shown as being inserted so as to apply equal and opposite forces to the inner faces of the latching mechanisms to separate the mechanisms simultaneously to their second open position. The inner faces 53 and 54 of the latching mechanisms 40 and 41, respectively, define or terminate in edge lock dogs 55 and 56, respectively, which engage with the hooks 27 and 28 of the locking tong 25 of the latch plate 22 as the latch mechanisms 40 and 41 are urged to their inner locking position to secure the latch plate 22 within the buckle 24.

Figure 6:
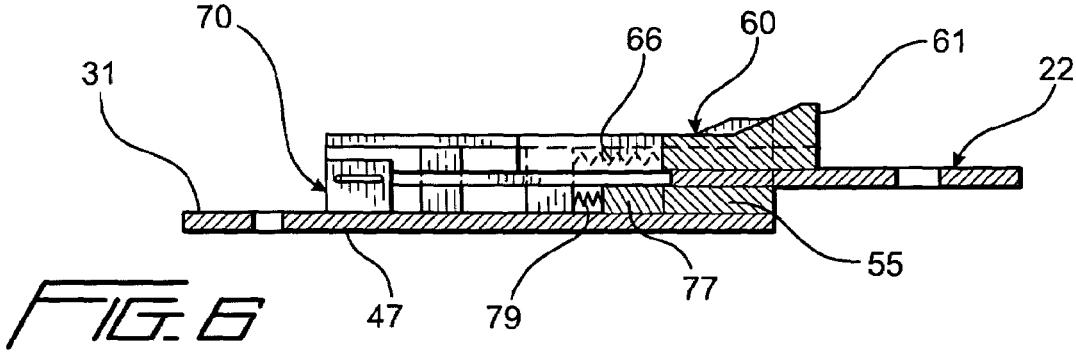
FIG. 6 is a cross-sectional view taken along line 6—6 of FIG. 3.
Figure 7:
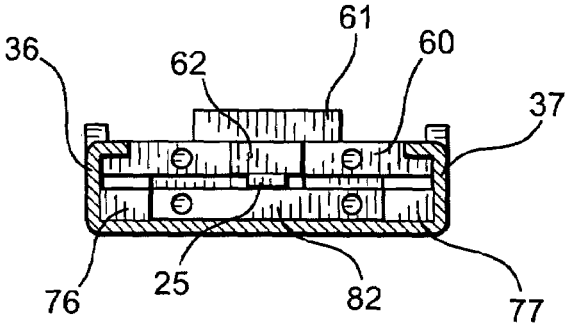
FIG. 7 is a cross-sectional view taken along line 7—7 of FIG. 3.
Figure 8:
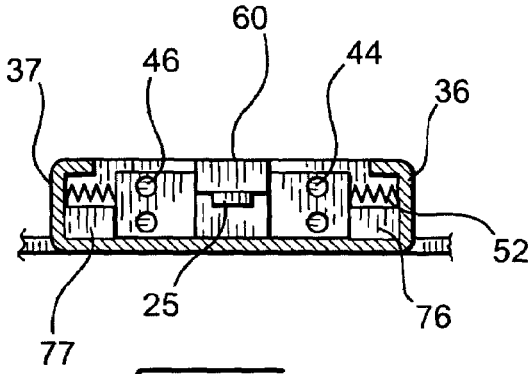
FIG. 8 is a cross-sectional view taken along line 8—8 of FIG. 3.

Also mounted within the buckle 24 and to the buckle frame 31 is a guide plate 55 which is secured, such as by rivets, screws or other fasteners (not shown), to the rear wall 37 of the buckle frame 31, see FIGS. 6–8. The plate 55 generally extends about the guide blocks 43, 44, 45 and 46 and between the guide blocks and the sides 36 and 37 of the buckle frame and provides a supporting surface for latch plate 22 and it's tong 25.

To release the latch plate 22 from the buckle 24, the invention incorporates a slide release member 60 which is moveably guided within the opposing channels 38 defined by the side walls 36 and 37 of the buckle frame 31. As shown in FIG. 3, the slide release member is seated over the latch plate and latch tong so as to be slideable toward and away from the space between the opposing latch mechanisms 40 and 41. The slide release member is preferably formed of a plastic material such as a high density polyethylene material (HDPE) and includes a body portion having an integrally formed push button 61 extending upwardly from one end thereof as shown in FIGS. 3, 6 and 12.

The opposite end of the slide release member includes a central projection 62 having a forward end which is tapered at 63 and 64 so as to cooperatively engage with the tapered or beveled inner surfaces 53 and 54, respectively, of the latch mechanisms 40 and 41. In this manner, when the slide release member is in a first position as shown in FIG. 3, the central projection 62 is in a position where it does not separate the latch mechanisms 40 and 41 and thus the locking tong 25 of the latch plate 22 is retained engaged by the latch mechanisms 40 and 41. However, when the slide member is moved, by engaging the push button 61, inwardly of the buckle to a position as shown in FIG. 4, the beveled ends 63 and 64 of the projection 62 force the latch mechanisms 40 and 41 against the springs 52 and simultaneously urge them outwardly to their second or release positions to thereby release the latch plate 22 from the buckle 24.

To return the slide release member 60 to it's first non-release position, as shown in FIG. 3, a pair of return springs 65 and 66 are mounted between the guide blocks 44 and 46 and an inner edge 48 of the slide release member. When the slide release member is urged inwardly to move the latch mechanisms 40 and 41 to their second or outer release positions, the springs 65 and 66 are compressed. As soon as the latch member 22 is pulled from the housing, the springs will automatically cause the slide release member to move to its outermost position as shown in FIG. 3.

To further assist in the ejection of the latch plate 22 from the buckle 24, a kick-out mechanism 70 is provided within the buckle. With specific reference to FIG. 10, the kick-out mechanism 70 includes an outer housing 71 in which is mounted a kick-out piston 72 which is resiliently urged by a coil spring 73 mounted between the housing 71 and the piston 72. The piston includes opposite guide tabs 74 which are slidably guided within opposing slots 75 in the housing 71 and limit the movement of the piston 72 within the confines of the opposing slots.

To positively guide the slide release member 60 within the buckle 24, opposing slots 80, only one being shown in drawing FIG. 3, are provided in opposite side walls of the body of the slide release member. Rivets 81 extend inwardly from the side walls of the buckle frame 31 and thereby guide and effectively limit the inner and outer travel of the slide release member relative to the buckle and prevent the withdrawal of the slide release member from the buckle.

Figure 9:
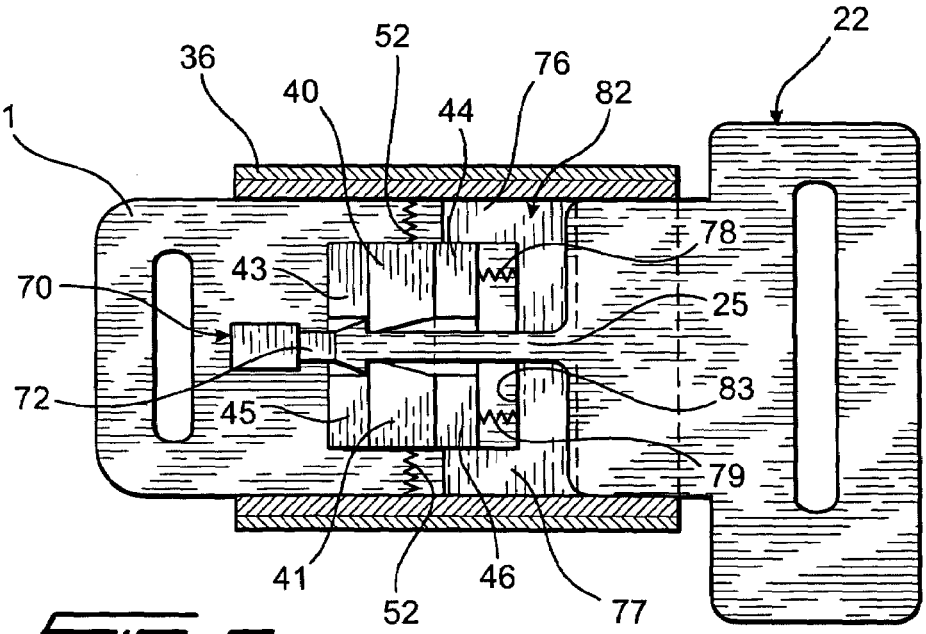
FIG. 9 is a top cross-sectional view of the embodiment shown in FIG. 3 with the latch slide release member being removed from the buckle.
Figure 10:
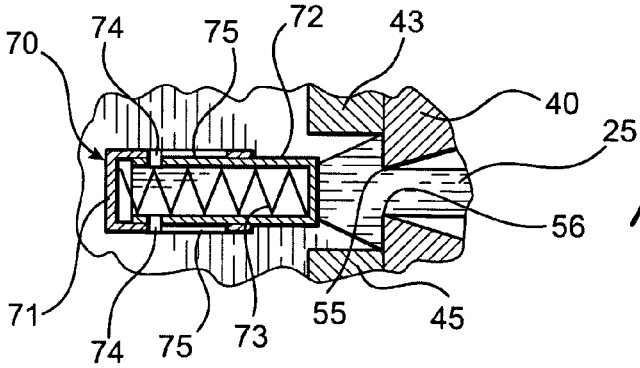
FIG. 10 is an enlarged cross-sectional view showing a kick-out spring assembly for urging the latch plate from the buckle when the latch mechanisms are moved to the open position shown in FIG. 4.
Figure 11:
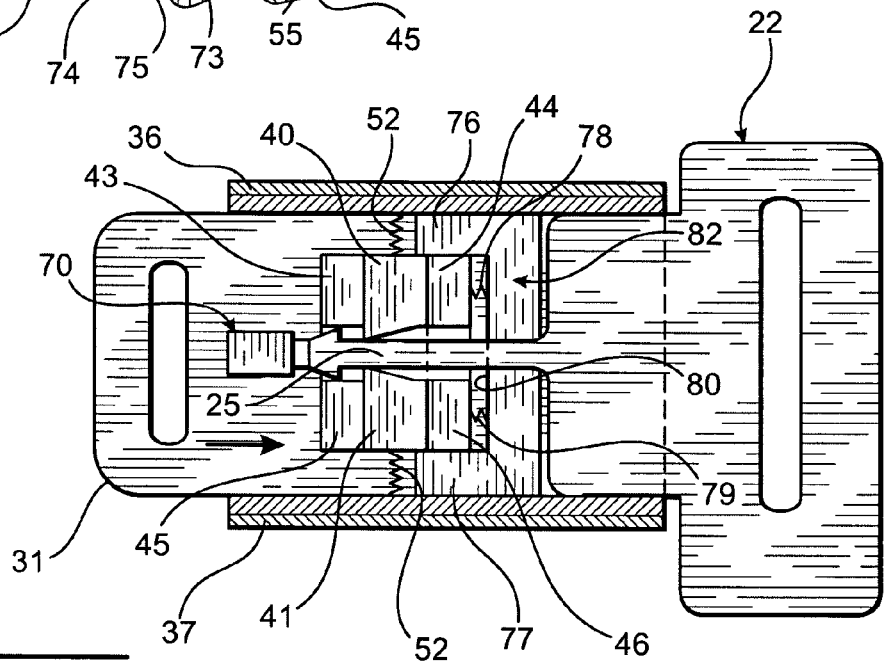
FIG. 11 is a view similar to FIG. 9 showing a u-shaped slide lock which prevents inadvertent release of the latching mechanisms in the event force is applied axially along the elongated axis A—A of the buckle assembly.

With specific reference to FIG. 9, 11 and 12, the invention incorporates a generally u-shaped lock bar 82 which is moveably mounted within the buckle 24 to prevent movement of the latch mechanisms 40 and 41 to their second release positions in the event any inertial force is applied against the buckle assembly which would tend to drive the slide release member 60 to a position to open the latches relative to one another when such action is not desired, such as during an accident. The lock bar includes a pair of spaced flanges 76 and 77 which extend between the guide blocks 44 and 46 and the outer walls 36 and 37 of the buckle frame 31. A pair of springs 78 and 79 extend from the guide blocks 44 and 46 and engage the central portion 83 of the lock bar 82 and normally urge it to a first position, as shown in FIG. 9, wherein the flanges 76 and 77 are spaced from the latching mechanisms 40 and 41. In this position, the lock bar does not prevent the latch mechanisms from being moved from their first inner locking position to their second outer release position. However, if an outside force is applied which would tend to drive the latch plate 22 inwardly of the housing during an accident, which force would also tend to drive the slide release member to its inner release position, such force will also urge the lock bar to the inner blocking position shown in FIGS. 11 and 12 wherein the outer flanges 46 and 47 block the latch mechanisms 40 and 41 from moving to their outer second release positions. In this manner, the locking tong 25 associated with latch plate 22 can not be inadvertently released by exterior forces being applied against the buckle assembly and along the central axis A—A thereof. Once the inertial or outside forces have passed, the springs 78 and 79 will urge the locking bar 82 to its first non-blocking position.

Figure 2:
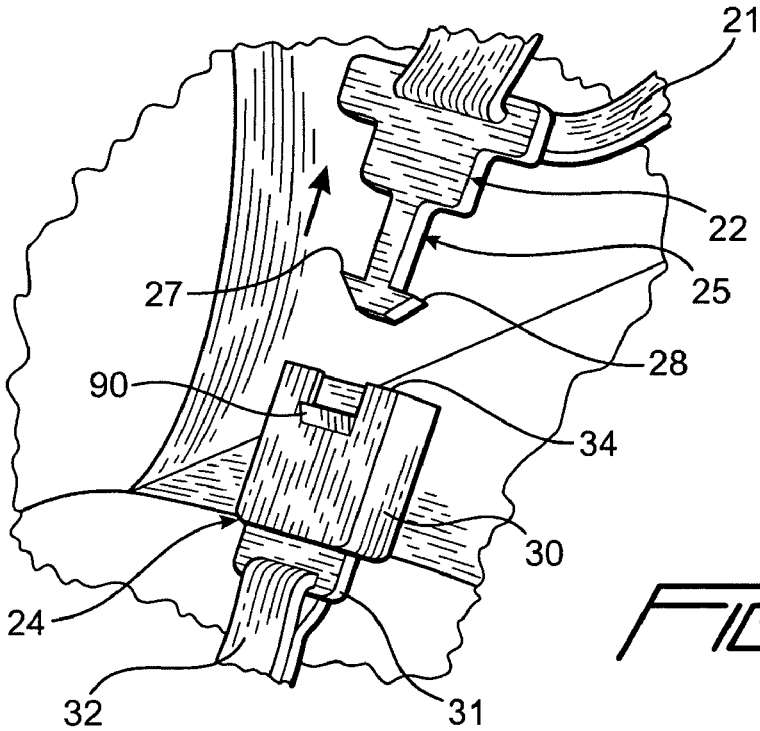
FIG. 2 is a view similar to FIG. 1 showing the latch plate being released upon the movement on a slide release member inwardly of the buckle assembly of FIG. 1.

With specific reference to FIGS. 1 & 2 the outer housing 30 of the buckle 24 includes a flared or domed section 90 adjacent the opening 34 in which the latch plate is received. The dome section extends slightly above the raised push button portion 61 of the release slide member 60 to provide clearance for the push button as it is moved from its outer position to an innermost releasing position. The dome section also provides protection for the slide release member and prevents inadvertent or accidental actuation thereof.

The foregoing description of the preferred embodiment of the invention has been presented to illustrate the principles of the invention and not to limit the invention to the particular embodiment illustrated. It is intended that the scope of the invention be defined by all of the embodiments encompassed within the following claims and their equivalents.

I claim:

1. A non-inertial release restraint buckle assembly for a vehicle having a restraining belt, the buckle assembly comprising; a buckle including a frame and a housing at least partially covering said frame, said buckle having front and rear ends and opposite sides, a latch plate receiving channel defined within said housing, an opening in said front end of said housing communicating with said latch plate receiving channel and of a size to receive a latch plate therein, a latch plate having a locking tong including oppositely oriented end portions, a pair of latching mechanisms slidable mounted within said housing so as to be reciprocally movable in a guide channel defined within said housing and which extends transversely to a central longitudinal axis of said buckle which extends from said front to said rear ends, biasing means disposed on opposite sides of said pair of latching mechanisms for urging said latching mechanisms in opposite directions toward one another to a first inner locking position wherein said latching mechanisms are engageable with said locking tong of said latch plate when said latch plate is inserted in said housing, a release member engageable with said latching mechanisms for moving said latching mechanisms simultaneously outwardly away from said central axis of said buckle to second release positions wherein said latching mechanisms are disengaged from said locking tong of said latch plate so that said latch plate may be removed from said housing, and said biasing means constantly urging said latching mechanisms toward said first inner locking position with oppositely directed forces such that when one of said latching mechanisms is urged away from said locking tong of said latch plate and toward said second release position by an inertial force, the inertial force applies a simultaneous increase in force to urge the other latching mechanism toward said locking tong of said latch plate thereby maintaining the other latching mechanism in said first inner locking position thereof such that both latching mechanisms are only simultaneously release able to permit release of said latch plate upon simultaneous application of forces to move said latching mechanisms from said first inner locking positions to said second release positions.

2. The non-inertial release restraint buckle assembly of claim 1 in which said release member for simultaneously moving said latching mechanisms outwardly to said second release positions includes a slide release member including a body mounted within said housing and a projection extending from said body so as to be selectively engage able with said latching mechanisms, and said slide release member including a push button portion selectively manually engage able to urge said slide release member from a first position to a second position in which said projection urges said latching mechanisms simultaneously outwardly with respect to one another to said second release positions.

3. The non-inertial release restraint buckle assembly of claim 2 in which said housing includes a domed portion for selectively receiving said push button when said push button is urged to move said slide release member to said second position.

4. The non-inertial release restraint buckle assembly of claim 2 including a lock resiliently mounted within said housing, said lock being moveable intermediate said latching mechanisms and said opposite sides of said buckle to prevent said latching mechanisms from moving to said second release positions if an inertial force is applied to said slide release member and said latching plate to drive them inwardly of said housing.

5. The non-inertial release restraint buckle assembly of claim 4 wherein each of said latching mechanisms includes a slide block including an inner tapered face which is engage able by one of said end portions of said locking tong when said latching mechanism is in said first inner locking position, said tapered face terminating at a lock dog for engaging said one of said end portions of said locking tong of said latch plate.

6. The non-inertial release restraint buckle assembly of claim 5 including a pair of spaced guide blocks mounted in said housing and defining said guide channel there between, and each of said slide blocks including means for engaging said guide blocks to prevent said slide blocks from being disengaged from within said guide channel.

7. The non-inertial release restraint buckle assembly of claim 6 wherein said buckle frame includes a pair of opposing sidewalls defining opposing channels for receiving a body of said latch plate when said latch plate is inserted in said opening in said front end of said housing.

8. The non-inertial release restraint buckle assembly of claim 6 in which said buckle frame includes a pair of opposing side walls defining opposing guide channels for said slide release member, and means for retaining said slide release member in sliding relationship within said opposing guide channels.

9. The non-inertial release restraint buckle assembly of claim 4 including resilient means for normally urging said slide release member to its first position.

10. The non-inertial release restraint buckle assembly of claim 9 including second resilient means for urging said latch plate from said buckle housing when said latching mechanisms are moved to said second release positions.

11. The non-inertial release restraint buckle assembly of claim 2 wherein each of said latching mechanisms includes a slide block including an inner tapered face which is engage able by one of said end portions of said locking tong, said tapered face terminating at a lock dog for engaging said end portion of said locking tong of said latch plate.

12. The non-inertial release restraint buckle assembly of claim 11 including a pair of spaced guide members mounted in said housing and defining said guide channel there between, and each of said slide blocks including means for engaging said guide members to prevent said slide blocks from being disengaged from within said guide channel.

13. The non-inertial release restraint buckle assembly of claim 1 including a lock mounted within said housing, said lock being moveable intermediate said latching mechanisms and said opposite sides of said buckle to prevent said latching mechanisms from moving to said second release positions if an inertial force is applied to said slide release member and said latching plate to drive them inwardly of said housing.

14. The non-inertial release restraint buckle assembly of claim 13 wherein said lock is generally u-shaped, and resilient means for normal urging said lock away from said latching mechanisms.

15. A method of providing a non-inertial safety restraint system for vehicles which system includes a latch plate having a generally centered locking tong, a buckle including a housing having an interior channel for selectively receiving the latch plate and a pair of oppositely oriented latching mechanisms movable within the housing from first locking positions engaging the locking tong of the latch plate to retain the latch plate within the housing to second release positions to permit insertion and removal of the latch plate relative to the interior channel of the housing, said pair of latching mechanisms being slidable mounted within said housing so as to be reciprocally movable in a guide channel defined within said housing and which extends transversely to a central longitudinal axis of said buckle which extends from a front end to a rear end of said housing, and wherein a release member is provided for simultaneously moving the latching mechanisms away from one another to the second release positions and which release member is slidably movable along said central longitudinal axis, the method including;

a) continuously urging the pair of latching mechanisms toward one another toward the first locking positions thereof by applying generally equal and oppositely directed resilient forces thereto, b) moving the pair of latching mechanisms against the resilient forces from the first locking positions thereof outwardly to the second release positions thereof as the latch plate is being inserted within the housing and, thereafter, when the latch plate is fully inserted within the housing the pair of latching mechanisms are moved to the first locking positions thereof by the resilient forces to thereby prevent withdrawal of the latch plate from the buckle housing, and c) releasing the latch plate from the pair of latching mechanisms only upon the simultaneous application of force to each of the latching mechanisms by moving the release member longitudinally with respect to the central longitudinal axis to move them away from one another within the housing to the second release positions thereof.

16. The method of claim 15 including the additional step of blocking the latching mechanisms from moving to said second release positions thereof only when a non-manual external force is applied longitudinally relative to the buckle which would tend to cause the release member to engage the latching mechanisms to move them to their second release positions.

* * * * *